US007152600B2

(12) United States Patent
Freriks et al.

(10) Patent No.: US 7,152,600 B2
(45) Date of Patent: Dec. 26, 2006

(54) BIOHAZARD MASK SUITABLE FOR CIVILIANS

(75) Inventors: David Richard Freriks, Hinckley, IL (US); Leonard F. Czuba, Lombard, IL (US)

(73) Assignee: Biokidz USA NFP, Hinckley, IL (US)

( * ) Notice: Subject to any disclaimer, the term of this patent is extended or adjusted under 35 U.S.C. 154(b) by 188 days.

(21) Appl. No.: 10/459,417

(22) Filed: Jun. 11, 2003

(65) Prior Publication Data

US 2006/0201511 A1 Sep. 14, 2006

Related U.S. Application Data

(60) Provisional application No. 60/441,802, filed on Jan. 22, 2003.

(51) Int. Cl.
*A62B 7/10* (2006.01)

(52) U.S. Cl. ..... 128/205.27; 128/205.29; 128/206.15

(58) Field of Classification Search ..... 128/205.25, 128/205.27, 205.28, 205.29, 206.12, 206.13, 128/206.14, 206.15, 206.16, 206.17, 206.18, 128/206.21, 206.23, 206.24, 206.25, 206.26, 128/206.27, 206.28, 207.11, 207.12, 207.13, 128/201.22, 201.23, 201.24, 201.25, 201.29
See application file for complete search history.

(56) References Cited

U.S. PATENT DOCUMENTS

| | | | | |
|---|---|---|---|---|
| 476,486 | A * | 6/1892 | Pozdena | 128/206.15 |
| 3,633,575 | A * | 1/1972 | Brumfield | 128/206.15 |
| 4,454,881 | A | 6/1984 | Huber et al. | |
| 4,595,003 | A * | 6/1986 | Shoemaker et al. | 128/201.19 |
| 4,771,771 | A * | 9/1988 | Walther | 128/201.25 |
| 5,069,205 | A * | 12/1991 | Urso | 128/201.24 |
| 5,131,387 | A | 7/1992 | French et al. | |
| 5,357,947 | A | 10/1994 | Alder | |
| 5,431,156 | A * | 7/1995 | Sundstrom | 128/201.23 |
| 5,517,986 | A * | 5/1996 | Starr et al. | 128/206.24 |
| 5,595,173 | A | 1/1997 | Dodd, Jr. | |
| 5,669,375 | A * | 9/1997 | Dahrendorf et al. | 128/206.17 |
| 5,884,624 | A | 3/1999 | Barnett et al. | |
| 6,062,220 | A | 5/2000 | Whitaker et al. | |
| 6,062,222 | A * | 5/2000 | Lewis et al. | 128/207.11 |
| 6,082,360 | A | 7/2000 | Rudolph et al. | |
| 6,216,693 | B1 * | 4/2001 | Rekow et al. | 128/205.27 |
| 6,224,655 | B1 * | 5/2001 | Messier | 96/226 |
| 6,345,620 | B1 * | 2/2002 | Salapow et al. | 128/206.17 |

(Continued)

FOREIGN PATENT DOCUMENTS

| | | | | |
|---|---|---|---|---|
| GB | 2228420 | * | 8/1990 | 128/206.17 |

OTHER PUBLICATIONS

U.S. Appl. No. 60/290,513*

(Continued)

*Primary Examiner*—Teena Mitchell
(74) *Attorney, Agent, or Firm*—Niro, Scavone, Haller & Niro

(57) ABSTRACT

A biohazard mask for civilian use comprises bidirectional HEPA filtering to protect both personal and public health during an outbreak. Several measures are taken to maximize comfort and wearability, such as comfort-fit through a gel seal, anti-fogging protection through separation of the eye volume from the mouth-nose volume and through eye moisture release valves, heat-dissipation through a net suspension, and overpressure release valves to maintain the face seal during coughing or sneezing. Wicking exhalation filters promote moisture abatement around the mouth and nose. Attractive and stylish designs, combined with accommodation for telephone communication or audio entertainment, helps wearers keep the mask on during an outbreak.

38 Claims, 5 Drawing Sheets

U.S. PATENT DOCUMENTS

| | | | | |
|---|---|---|---|---|
| 6,375,854 | B1 | 4/2002 | Beplate | |
| 6,397,847 | B1 | 6/2002 | Scarberry et al. | |
| 6,401,716 | B1 | 6/2002 | Sword et al. | |
| 6,460,539 | B1 * | 10/2002 | Japuntich et al. | 128/205.27 |
| 6,543,450 | B1 | 4/2003 | Flynn | |
| 6,584,976 | B1 | 7/2003 | Japuntich et al. | |
| 6,588,424 | B1 | 7/2003 | Bardel | |
| 6,631,718 | B1 | 10/2003 | Lovell | |
| 6,659,102 | B1 * | 12/2003 | Sico | 128/206.15 |
| 6,681,765 | B1 | 1/2004 | Wen | |
| 6,689,278 | B1 | 2/2004 | Beplate | |
| 6,701,925 | B1 | 3/2004 | Resnick | |
| 6,736,137 | B1 * | 5/2004 | Resnick et al. | 128/201.25 |
| 2002/0023651 | A1 | 2/2002 | Japuntich et al. | |
| 2002/0129818 | A1 | 9/2002 | Morgan et al. | |
| 2003/0005934 | A1 | 1/2003 | Japuntich et al. | |
| 2003/0047183 | A1 * | 3/2003 | Kiefer et al. | 128/201.15 |
| 2003/0111074 | A1 | 6/2003 | Alon et al. | |
| 2004/0003810 | A1 | 1/2004 | Templeton | |
| 2004/0011363 | A1 | 1/2004 | Wiener et al. | |

OTHER PUBLICATIONS http://www.gasmasklexikon.com "The Armored-Vehicle Protective-Mask History" (pp. 1-8).

MSA Defense Product's MCU-2/P series (pp. 1-5).

http://www.gasmasks.net "Le Masque a Gaz" (p. 1).

PCT Search Report May 26, 2005.

NanoMask—downloaded Dec. 13, 2004 High tech, low cost protection from air borne contaminates.

* cited by examiner

BIOHAZARD MASK SUITABLE FOR CIVILIANS

RELATED APPLICATIONS

This application claims priority to provisional application No. 60/441,802, filed Jan. 22, 2003.

FIELD OF THE INVENTION

This invention relates to masks which protect against biological hazards.

BACKGROUND OF THE INVENTION

Terrorists are thought capable of launching a major biological attack on civilian populations. They might use localized biohazardous material, such as weaponized anthrax, or they might use deadly infectious agents, such as smallpox. Numerous such materials and agents exist, each with its own transmission efficiency, survivability in the atmosphere, portability, resulting symptoms, resulting morbidity and resulting mortality.

Man-made threats are not the only ones seemingly on the rise. The prospect of a pandemic from the spread of natural infectious agents also seems to be increasing. The 2003 SARS outbreak is a recent example. Putting such natural events into perspective, the 1918 influenza pandemic is widely thought to have killed more soldiers during WWI than did combat.

The inventors know of no prior biohazard protective gear designed particularly with the needs of civilians in mind. During an outbreak, public health will require widespread use of the most effective biohazard protection gear available. This entails equipment that maximizes comfort and wearability, yet minimizes the receipt and re-transmission of deadly or dangerous infectious agents. Comfort and wearability are especially important, given that users will need to wear the gear for long periods of time yet will lack the discipline which comes from military training.

Biohazard protective gear is most commonly designed for military applications. U.S. Pat. No. 6,158,429, assigned to the United States of America as represented by the Secretary of the Army, is exemplary of this art. It discloses a hood respirator for protection against biological hazards. The device disclosed therein is a complete hooded respirator assembly form fitting to the head and neck of the user. There are two HEPA filters for intake, one adjacent each cheek, as well as an exhalate "breathe-through airflow assembly." The hooded respirator also contains a clear eye lens. The '429 patent recognizes that protection against biological agents requires only HEPA filtering, whereas protection against chemical agents, too, would require the addition of activated carbon filtering. While the '429 patent discloses filtering inhalate, it does not disclose filtration of outgoing exhalate. The device disclosed therein would therefore be of limited use during a pandemic, or in the presence of any number of infectious biological warfare agents on the battlefield or during a terrorist attack, since an infected wearer of the assembly might still be a disease vector. The '429 patent's hooded respirator also comprises a single volume enclosing the eyes, nose and mouth. This poses a fogging problem, requiring a "solution" of re-directing inhaled air across the interior of the lens. Under high humidity conditions, this anti-fogging measure might not work. Since this single volume must enclose the eyes as well as the nose and mouth, it also acts as a reservoir for $CO_2$, reducing comfort and wearability. The hood can be hot for the wearer, too.

U.S. Pat. No. 5,957,131, also assigned to the United States of America as represented by the Secretary of the Army, discloses a biological warfare mask. The mask shown therein does not include eye protection. Instead, it shows two tubes to fit inside the nostrils, and a mouthpiece to fit inside the mouth. Thus this mask cannot protect against the many infectious agents which enter through the eyes. Nor is there filtering of exhalate.

Exemplary military gas masks, or combined chemical-biological masks, are shown in U.S. Pat. Nos. 5,181,506 and 6,176,239, respectively, both assigned to the United States of America as represented by the Secretary of the Army. These masks require carbon filtering. These masks were apparently not designed with long-term civilian use in mind. They lack any disclosure of exhalate filtering, and the '239 patent in fact attributes specific disadvantages to filtering of exhalate. And like the device of the '429 patent, the devices disclosed therein permit lens fogging through exhalate moisture build-up, which then must be abated with the "solution" of passing inhalate across the lens interior.

It is thus an object of the invention to provide a biohazard mask designed with the needs of civilian populations (adults and children) in mind.

SUMMARY OF THE INVENTION

The present invention accommodates the goals of a civilian biohazard mask through a number of design features, appearing as recited in various instances and combinations in the appended claims. For maximum effectiveness against disease re-transmission (particularly useful during household quarantines or at healthcare facilities), the invention provides HEPA filtering for both inhalate and exhalate. For maximum protection against lens fogging, the eye volume is separate from the mouth and nose volume. The eye volume further includes water vapor-permeable, agent-impermeable, membranes to allow release of built-up water vapor, augmented with a passive air-circulation system. For maximum breathing comfort, the mouth-nose volume is minimized, and measures are taken to maximize moisture discharge. For maximum wearability and comfort, the mask is sealed to the face using a combination memory seal/gel seal, and is suspended from the head using netting.

Bidirectional filtering is of particular significance during a pandemic or localized epidemic. When a highly transmissible and particularly deadly infectious agent pervades the environment, civil authorities will likely impose quarantines. Thus there will be an increased likelihood of infected people living in close quarters with otherwise uninfected people. Moreover, health care facilities will likely receive many infected people for care, creating another highly concentrated population of infected people in close quarters with otherwise uninfected people. Since in many cases a person may re-transmit a disease long before the onset of symptoms, there is a heightened need to provide a biohazard mask that minimizes re-transmission.

Other inventive aspects of the contributions herein will be apparent from the detailed description as augmented by the drawings.

DETAILED DESCRIPTION OF THE PREFERRED EMBODIMENT

Figure 1:
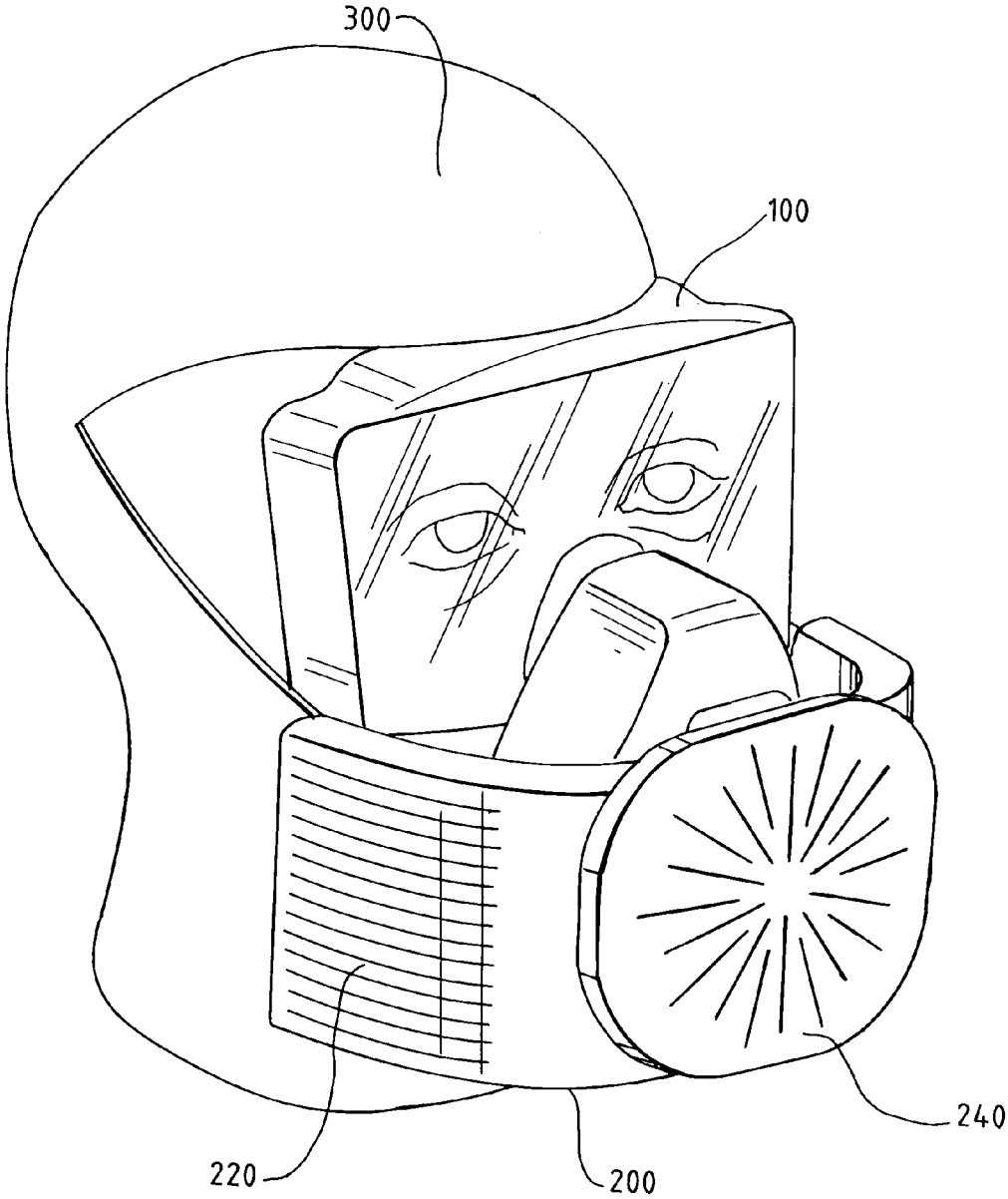
FIG. 1 shows a perspective view of the mask of the present invention.

Identical reference numerals are intended to reflect identical parts and features in each of the figures.

Directing attention to FIG. 1, there is shown a perspective view of one embodiment of the biohazard protective gear of the present invention. FIG. 1 shows a mask of the present invention covering the face of the wearer. The mask includes a lens portion 100, a mouth-nose portion 200, and a suspension portion 300.

The lens portion 100 may be made of any clear lens material, preferably polycarbonate, and most preferably polycarbonate that may flex during ordinary movement of the wearer. Lens portion 100 also preferably includes two further structures (not shown) that function to remove moisture from the eye area. One is a water vapor-permeable, biological agent-impermeable membrane, preferably TYVEK, and most preferably TYVEK of over one square inch surface area on each side of the lens portion. The other is a one way air release valve in communication with the air in the eye volume that acts at a pressure resistance lower than the membrane for gradually releasing moist eye-volume air into the ambient environment upon ordinary flexion of the lens material or ordinary movement of the face against the seal. That is, ordinary face and body movements of the wearer are sufficient to "squeeze" moist air out of the valve on a regular basis, which will then be replaced by continual entry of sanitary, dry ambient air passing inwardly through the permeable membrane. The membrane and release valve act to abate moisture buildup in the eye area, and thus minimize fogging. Another feature of the mask that contributes to moisture abatement and anti-fogging is that the eye volume is sealed separately from the mouth-nose volume, to be discussed below.

In an alternative embodiment, lens portion 100 may suitably accommodate prescription lenses, either by permitting a large enough interior volume to fit conventional glasses or pince-nez, or alternatively by permitting snap-fit engagement of prescription lenses in the manner described in column 5 of U.S. Pat. No. 5,181,506, or equivalent means.

The mouth-nose portion 200 of the mask of the embodiment of FIG. 1 may be made of any suitable durable and impermeable material, and contains two main parts. These are the inhalation section 220, and the exhalation section 240. As shown, these respectively contain inhalation and exhalation apertures. In the embodiment of FIG. 1, these are separate sections, each with their own filter and valve assembly, preferably HEPA filters (e.g., polyester/glass filters), and most preferably HEPA filters containing or impregnated with a biocidal agent. Such biocidal agents can be any substance that tends to destroy biologically active agents (such as spores, bacteria or viruses), while being incapable of being inhaled through the filter assembly or otherwise harming the wearer if inhaled. Such substances may preferably include elemental silver, and may also include silver compounds such as silver oxide, silver sulfadiazine and/or silver-hydrogel, or may include chlorhexidine and/or hypochlorite, most preferably in powdered form. Commercially available HEPA filter material of these types are generally available from supply houses such as 3M or Reemay.

The suspension portion 300 of the mask of the embodiment of FIG. 1 is of lightweight but strong material, and is designed to hang the mask from the wearer's face and/or head in such a manner for the mask to create a proper seal (discussed below). To maximize comfort, and particularly to minimize heat build-up that would otherwise occur with ordinary straps or fabrics, the suspension portion 300 is made of a netting material. This can be in the form of the same material and configuration used in commercially available hair net products. Alternatively, the netting can be in the configuration of a standard fishing net. Appropriate materials may include lycra, nylon, or polyester. Such commercially available netting material may be obtained from George C. Moore Co. Netting provides several advantages, namely, improved weight and heat distribution over fabric head-coverings or straps, as well improved frontal and rear ability to recognize a wearer. The suspension portion 300 need not be a complete head covering. It may instead comprise netted straps configured appropriately to seal the mask to the face (described below).

Figure 2:
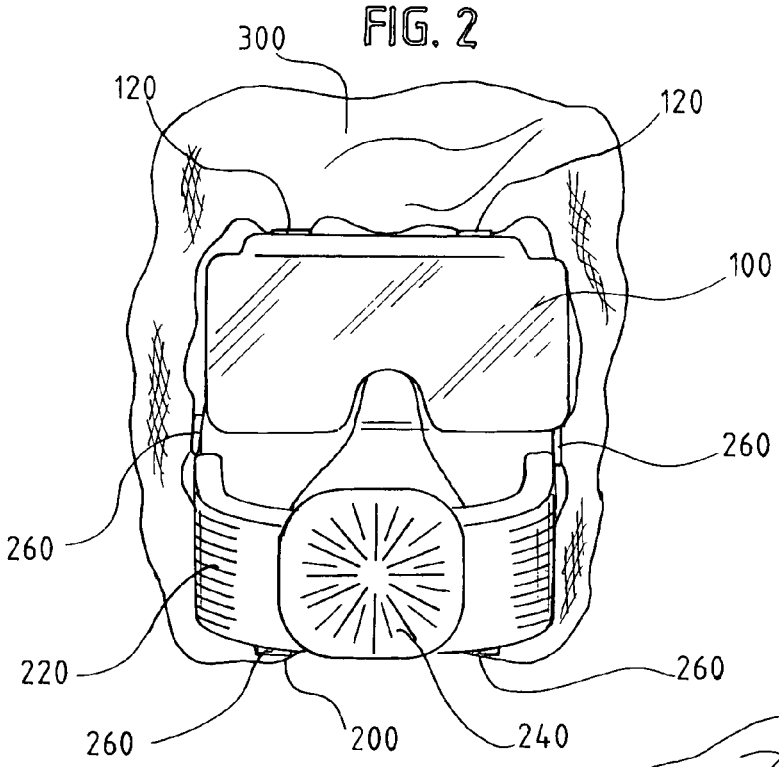
FIG. 2 shows a frontal view of the mask of the present invention.

Directing attention to FIG. 2, there is further shown the points of attachment 120 of the suspension portion 300 to the lens portion 100, as well as points of attachment 260 to the mouth-nose portion 200. These points of attachment may be in the form of loops for receiving buckled nylon straps, or may comprise any sufficient means to fasten the suspension portion 300 to the mask.

Figure 3A:
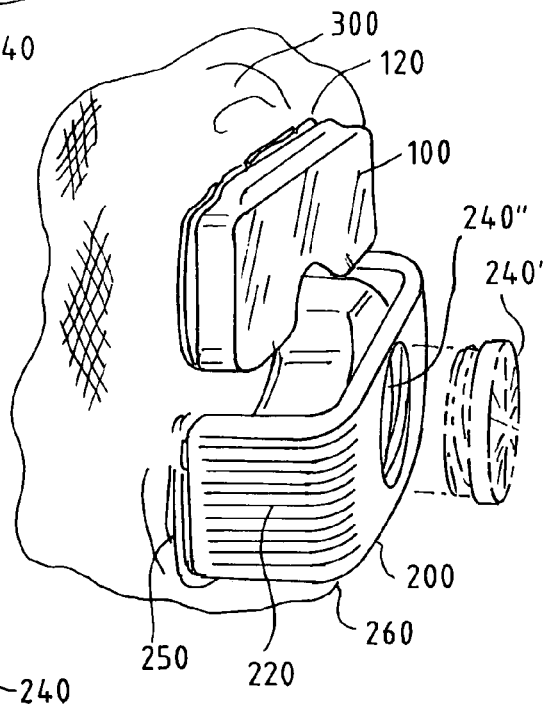
FIG. 3A shows the side view of FIG. 3 which includes a view of a screw-type receptacle for an exhalation filter cartridge.
Figure 3:
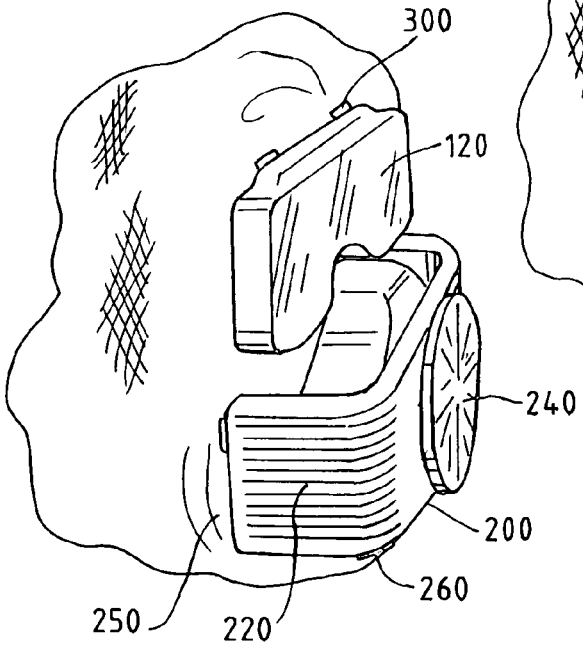
FIG. 3 shows a side view of the mask of the present invention.

Directing attention to FIG. 3, there is further shown the seal 250. Seal 250 rests on the substantially annular edge of the curvilinear surface that makes up the mask, and is intended to touch the user's face to ensure that respiration airflow is exclusively through the filters. As shown also in connection with FIG. 4, seal 250 helps define two separate non-communicating volumes within the mask when seated on a wearer's face: the eye volume and the mouth-nose volume. As mentioned, the separation of these volumes contributes to the anti-fogging aspects of the present embodiment. The seal itself may constitute any number of materials, for example an adhesive, a memory seal (such as that discussed in column 3 of U.S. Pat. No. 5,836,303), or preferably a gel seal (such as that discussed in column 4 of U.S. Pat. No. 5,181,506). Such gel seals are available from companies like Pittsburgh Plastics, Inc. The seal may also constitute a gel seal seated atop a memory seal.

Figure 4:
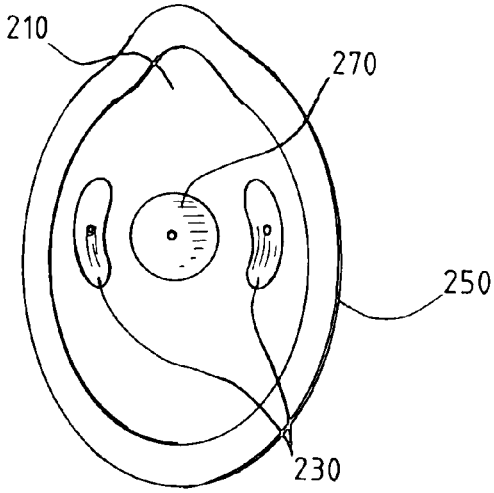
FIG. 4 shows a view of the interior surface of the mouth-nose cone of the present invention.

Directing attention to FIG. 4, there is shown a view of the inside surface 210 of mouth-nose portion 200. The inhalation section 220 communicates with the interior of the mask through inhalation valves 230. Valves 230 may be disk or dome valves concave toward the face which are very slightly spring-biased closed. Thus, upon inhalation, valves 230 easily open to permit complete airflow passage into the mouth-nose volume through the inhalation HEPA filters. Note that inhalation section 220 is associated in this embodiment with two inhalation valves 230, and involves two intake areas, one adjacent each cheek. These exterior of these intake areas are hard three-dimensionally curved surfaces. This is to permit sleeping in the mask with minimum suffocation risk and maximum comfort. The exhalation section 240 communicates with the interior of the mask through exhalation valve 270. Valve 270 may also be a disk or dome valve, this time convex toward the face and very slightly spring-biased closed. Upon exhalation, valve 270 easily opens to permit complete airflow passage out of the mouth-nose volume through the exhalation HEPA filter.

Turning again to filter characteristics, the inhalation HEPA filter should preferably be selected to provide up to 1 square foot of total filtration surface. The exhalation HEPA filter has different design criterial from the inhalation HEPA filter because of the moisture content of exhaled breath. Thus, it can be preferably of somewhat less total filtration surface, and should have a more open weave. In addition, to maximize water vapor dispersion, some portion of the filter fibers can be of the hollow variety to augment wicking. In addition, the filter medium may be electrically charged, which further helps abate moisture during exhalation.

Figure 5:
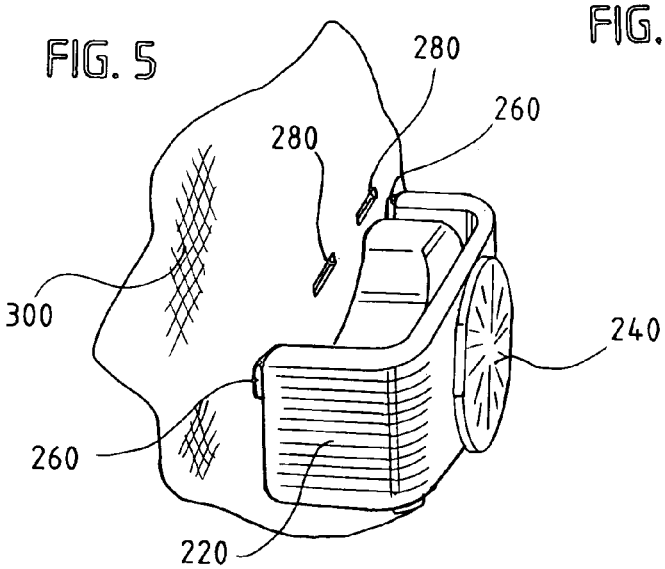
FIG. 5 shows a side view of the mask of the present invention, with the removable lens omitted making it a half mask.

Directing attention to FIG. 5, the present embodiment may be made into a half mask by removal of lens 100. Slots 280 are shown into which one may removably insert lens 100. For masks designed with a removable lens 100, the seal 250 must be commensurately designed to allow for free insertion and removal of the lens 100.

Figure 6A:
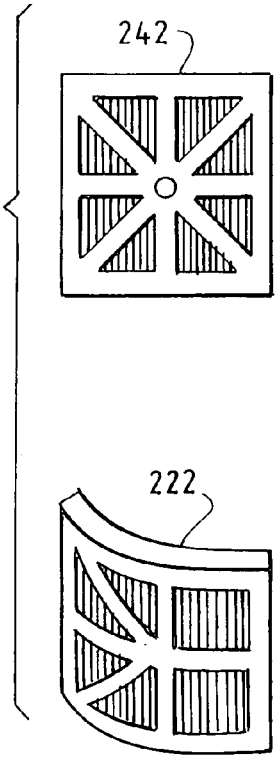
FIG. 6A shows an inhalation filter cartridge and an exhalation filter cartridge designed for slidable engagement.
Figure 6:
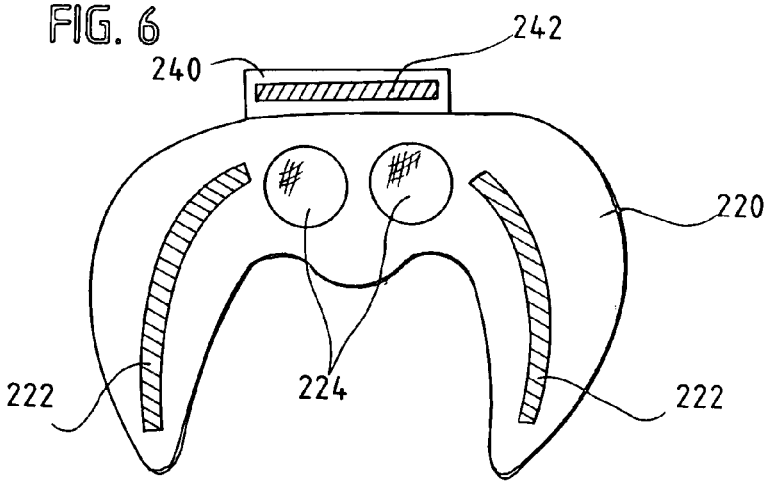
FIG. 6 shows a view of the underside of the mask of the present invention.
Figure 7:
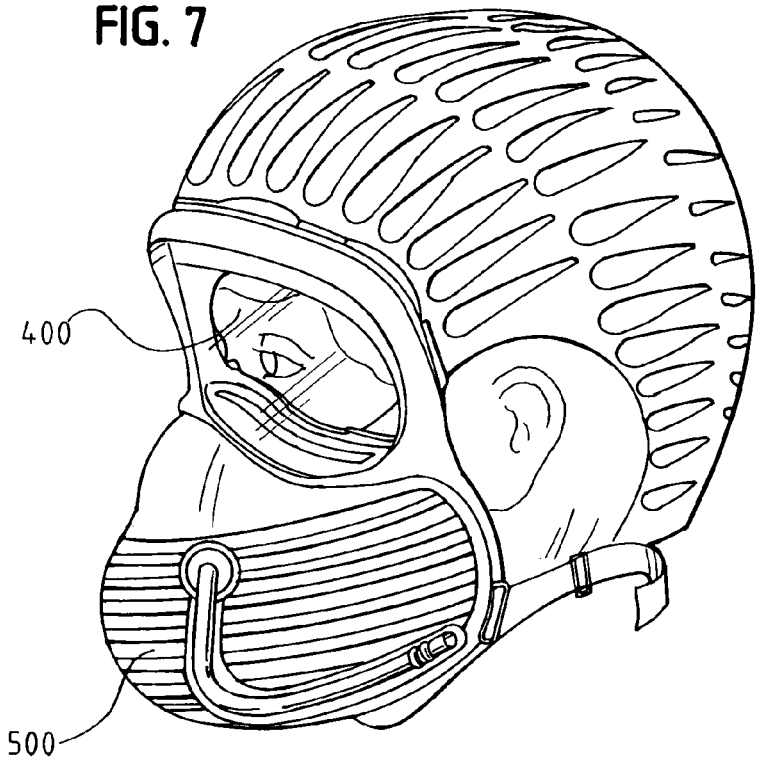
FIG. 7 shows a perspective view of an alternate embodiment of the mask of the present invention.
Figure 8:
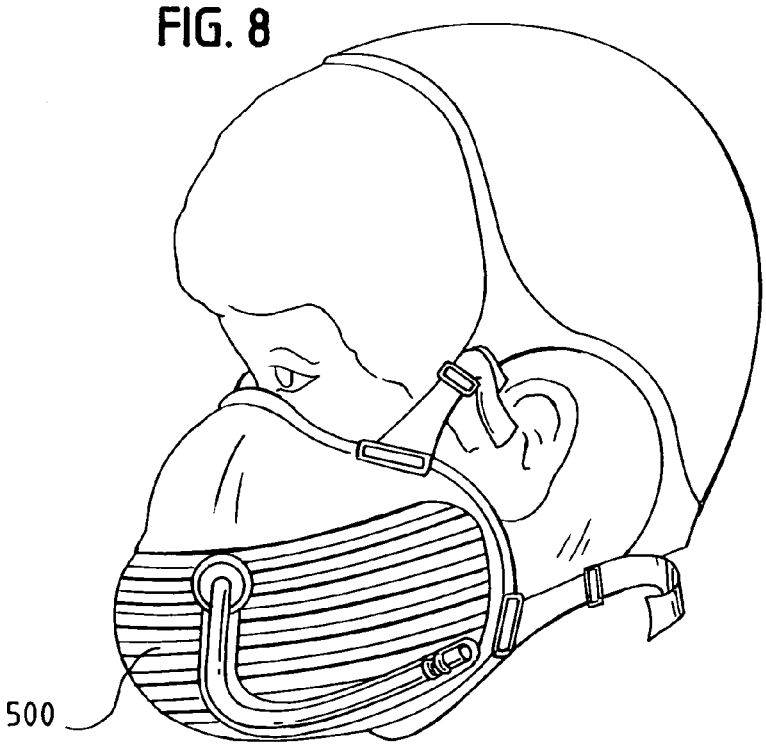
FIG. 8 shows a perspective view of an alternate half mask embodiment of the present invention.
Figure 9:
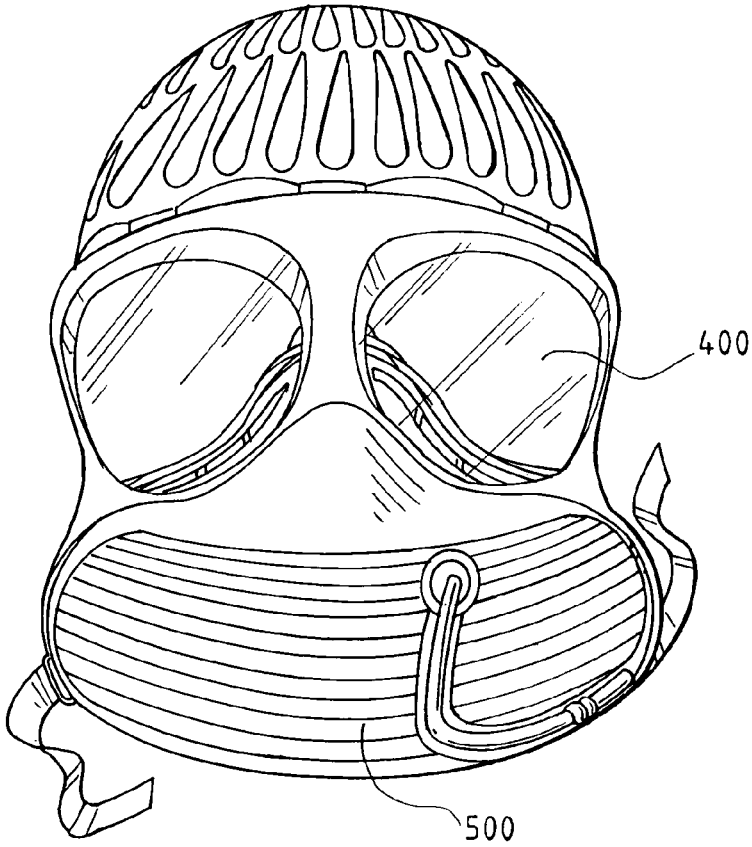
FIG. 9 shows a frontal view of the alternate embodiment of FIG. 8.
Figure 10:
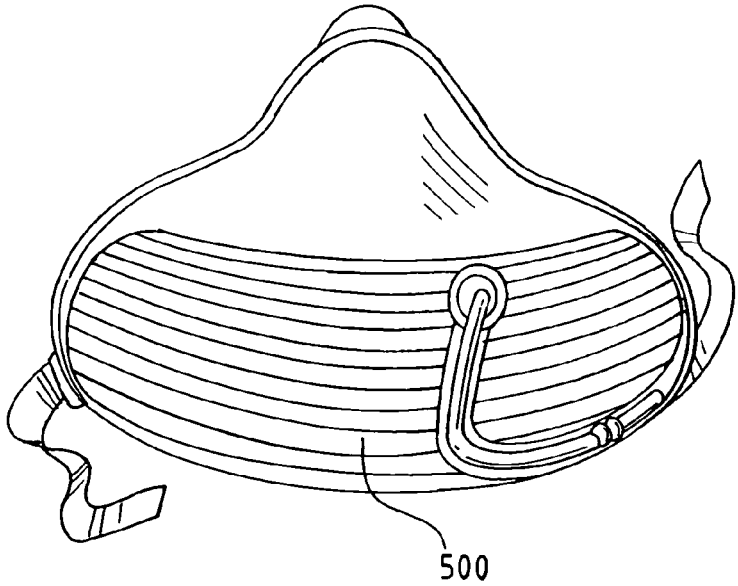
FIG. 10 shows a frontal view of the alternate embodiment of FIG. 9.

Directing attention to FIG. 6, there is shown the underside of the mask of the present embodiment. Two additional features come into this view. First, the inhalation filters 222 comprise removable cartridges, and the exhalation filter 242 comprises a further removable cartridge. While the cartridges are depicted as the sliding variety, any variety will do, for example screw-on (See FIG. 3A depicting a screw-type receptacle 240" for engaging exhalation filter cartridge 240'). The underside also shows the measures taken to facilitate overpressure relief. The sealed mask of the present embodiment filters exhalate. But people sneeze and cough. This poses the risk of temporarily breaking the face seal 250, or of forcing exhalate out through the HEPA filter faster than is desired for maximum filtration efficiency. Thus, the embodiment shown includes two membranes 224 which serve as an over-pressure relief mechanism. Similar in appearance when inflated to a frog bubbling its chin, the membranes (which may be latex rubber or any equivalent such as polyisoprene) will inflate during sneezes, coughs, or other overpressure situations. In this way, the seal will be maintained, and the inflated membranes holding potentially infected air will be allowed to dissipate the air gradually through the exhalation HEPA filter.

Other features of the mask of the present embodiment which are not shown include a KAPTON vocal membrane to facilitate speech. If it is desired, electronic communications may also be accommodated. Thus, a microphone might be placed inside the mouth-nose volume, connected to a microphone jack somewhere on the surface of the mask. In addition, in masks designed to cover the ears, ear speakers may also be included, and similarly jacked in. Thus, in an alternate embodiment, a wearer can interface with a telephone, or with audio entertainment, without removing the mask and compromising personal or public health during an outbreak. Inclusion of telephone or entertainment capabilities also maximizes user comfort and wearability. Also not shown, a drinking straw may be suitably inserted through the mask in an appropriate place to permit ingestion of liquids without removing the mask. It will also be appreciated that the mask of the present embodiment may be ornamented with designs or fashion elements to encourage continued use throughout an outbreak. In this light, the durable material that makes up the mask may be formed from translucent or transparent polymer material, and such material may in turn be infused with various light pastel colors or designs. A substantially clear or translucent mask enhances wearer recognizability, and would also make for an attractive, sleek design that encourages continued use throughout an outbreak. (Of course, the filters are opaque.).

FIGS. 7–10 show a second embodiment of the protective gear of the present invention. Unless otherwise noted, the features and characteristics of the second embodiment may be suitably accomplished using the materials and structures described in connection with the first embodiment. There are two main differences between the first and second embodiments. In this second embodiment, the lens 400 is no longer one-piece, but is more of a goggle variety. In addition, instead of mouth-nose portion 200 containing separate filters which segregate inhalation and exhalation through a valve arrangement, mouth-nose portion 500 has no valves and instead comprises a single HEPA filter for both inhalation and exhalation. This configuration allows a greater amount of surface area to be devoted to filtering, and thus has the potential of permitting lower pressure resistance during breathing. In FIGS. 7–10, the drinking straw is specifically depicted.

It will be appreciated that those skilled in the art may now make many uses and modifications of the specific embodiments described without departing from the inventive concepts. For example, while the embodiments show a mask, those of skill in the art may readily apply the inventive concepts herein to equivalent gear interchangeable with a mask in light of the teachings herein, e.g., a suit, a hood, or any other gear designed for protection of health. The recitation of the features and characteristics of the embodiments shown above is not meant to be limiting, but rather exemplary, with the appended claims and their equivalents defining the patentee's property rights hereunder.

We claim:

1. A biohazard mask comprising:

a curvilinear surface forming a face volume and having a substantially annular edge, the annular edge forming a face seal;

at least one inhalation aperture within the curvilinear surface;

an inhalation filter disposed between the inhalation aperture and the face volume;

an inhalation valve disposed to allow air to enter the face volume through the inhalation aperture and the inhalation filter, but not to allow air to escape in the other direction;

at least one exhalation aperture within the curvilinear surface;

an exhalation filter disposed between the exhalation aperture and the face volume, said exhalation filter contained within a cartridge which is removable and replaceable; and an exhalation valve disposed to allow air to exit the open volume through the exhalation aperture and the exhalation filter, but not to allow air to escape in the other direction;

whereby, the biohazard mask filters both inhalate and exhalate.

2. The invention of claim 1, wherein the inhalate and exhalate filters comprise HEPA filters.

3. The invention of claim 2, wherein the HEPA filters contain a biocidal agent.

4. The invention of claim 2 wherein the HEPA filters comprise removable, disposable cartridges.

5. The invention of claim 1, wherein the curvilinear surface further includes a lens section, and a mouth-nose section, the lens section and the mouth-nose section defining separate volumes when placed against the wearer's face.

6. The invention of claim 5, wherein the mouth-nose section forms a mouth-nose volume and has a substantially annular edge, the annular edge forming a mouth-nose seal; and the lens section forms a lens volume and has a substantially annular edge, the annular edge forming a lens seal.

7. The invention of claim 6, wherein the lens section is removably attached to the exterior surface of the mouth-nose section.

8. The invention of claim 5, wherein the lens section comprises a water vapor-permeable, agent-impermeable membrane.

9. The invention of claims 5 or 8, wherein the lens section comprises a flexible material and further comprises a valve assembly for releasing a portion of the enclosed air volume upon flexion of the flexible material, whereby the mask gradually exchanges the air surrounding the eye with ambient air during ordinary movement of the wearer.

10. The invention of claim 1 wherein the face seal comprises a gel seal.

11. The invention of claim 1 wherein the face seal comprises a gel seal seated on top of a memory seal.

12. The invention of claim 1 wherein the face seal comprises an adhesive.

13. The invention of claim 1 wherein the curvilinear surface comprises at least one inflatable over-pressure release membrane for ensuring face seal integrity and/or exhalation filter performance during sudden interior pressure increases.

14. The invention of claim 1 further including a head suspension system comprising a head net, the head net comprising points of attachment to the curvilinear surface for permitting the user to wear the mask by fitting the net on the head.

15. The invention of claim 1 further including a head suspension system comprising net straps, the net straps comprising points of attachment to the curvilinear surface for permitting the user to wear the mask by fitting the net straps around the head.

16. The biohazard mask of claim 1 wherein the mask includes at least one recess for slidably engaging the exhalate filter cartridge with the mask.

17. The biohazard mask of claim 1 wherein the mask includes at least one screw-type receptacle to allow the exhalate filter cartridge to screw onto the mask.

18. A biohazard mask comprising:

a curvilinear surface forming a face volume and having a substantially annular edge, the annular edge forming a face seal;

at least one aperture within the curvilinear surface;

a bi-directional HEPA filter disposed between the aperture and the face volume;

whereby, the biohazard mask filters both inhalate and exhalate such that substantially all of the air flowing into the face volume flows out of the face volume through the same filter.

19. The invention of claim 18, wherein the HEPA filter contains a biocidal agent.

20. The invention of claims 3 or 19 wherein the biocidal agent includes one or more from the list comprising elemental silver, silver oxide, silver sulfadiazine, silver-hydrogel, chlorhexidine and hypochlorite.

21. The invention of claim 18, wherein the curvilinear surface further includes a lens section, and a mouth-nose section, the lens section and the mouth-nose section defining separate volumes when placed against the wearer's face.

22. The invention of claim 21, wherein the mouth-nose section forms a mouth-nose volume and has a substantially annular edge, the annular edge forming a mouth-nose seal; and the lens section forms a lens volume and has a substantially annular edge, the annular edge forming a lens seal.

23. The invention of claim 22, wherein the lens section is removably attached to the exterior surface of the mouth-nose section.

24. The invention of claim 21, wherein the lens section comprises a water vapor-permeable, agent-impermeable membrane.

25. The invention of claims 21 or 24, wherein the lens section comprises a flexible material and further comprises a valve assembly for releasing a portion of the enclosed air volume upon flexion of the flexible material, whereby the mask gradually exchanges the air surrounding the eye with ambient air during ordinary movement of the wearer.

26. The invention of claim 18 wherein the face seal comprises a gel seal.

27. The invention of claim 18 wherein the face seal comprises a gel seal seated on top of a memory seal.

28. The invention of claim 18 wherein the face seal comprises an adhesive.

29. The invention of claim 18 wherein the curvilinear surface comprises at least one inflatable over-pressure release membrane for ensuring face seal integrity and/or filter performance during sudden interior pressure increases.

30. The invention of claim 18 wherein the HEPA filter comprises a removable, disposable cartridge.

31. The invention of claim 18 further including a head suspension system comprising a head net, the head net comprising points of attachment to the curvilinear surface for permitting the user to wear the mask by fitting the net on the head.

32. The invention of claim 18 further including a head suspension system comprising net straps, the net straps comprising points of attachment to the curvilinear surface for permitting the user to wear the mask by fitting the net straps around the head.

33. A biohazard mask comprising:

means for sealing the mask to a face; and means for filtering both inhalate and exhalate, said means for filtering including an exhalate-filtering removable and replaceable cartridge.

34. The invention of claim 33 further comprising means for releasing overpressured exhalate.

35. The invention of claim 33 further comprising means for replacing the means for filtering.

36. The invention of claim 33 further comprising:

a lens; and means for preventing fogging of the lens.

37. The invention of claim 33 further comprising means for preventing moisture buildup in the mouth area, whereby the mask increases user wearability and comfort.

38. The invention of claim 33 further comprising:

means for suspending the mask on the face of the user; and means for preventing heat build-up under the means for suspending.

* * * * *